US006176056B1

(12) United States Patent
MacKarvich

(10) Patent No.: US 6,176,056 B1
(45) Date of Patent: Jan. 23, 2001

(54) TIE-DOWN STRAP FRAME CONNECTOR

(76) Inventor: Charles J. MacKarvich, 1720 Tyler Green Trail, Smyrna, GA (US) 30080

( * ) Notice: Under 35 U.S.C. 154(b), the term of this patent shall be extended for 0 days.

(21) Appl. No.: 09/282,854

(22) Filed: Mar. 31, 1999

Related U.S. Application Data

(63) Continuation-in-part of application No. 09/195,468, filed on Nov. 18, 1998, now Pat. No. 5,983,573.

(51) Int. Cl.[7] ..... E02D 27/50

(52) U.S. Cl. ..... 52/293.3; 52/23; 52/715; 52/DIG. 11; 248/499; 248/503; 248/680; 403/353

(58) Field of Search ..... 52/23, 293.3, 712, 52/713, 715, 698, DIG. 11; 248/499, 500, 503, 680, 681; 24/192, 199, 311, 317; 403/353

(56) References Cited

U.S. PATENT DOCUMENTS 5,273,382 * 12/1993 Yearick ..... 411/64
5,927,895 * 7/1999 Watanabe ..... 403/353

* cited by examiner

*Primary Examiner*—Christopher T. Kent
*Assistant Examiner*—Yvonne M. Horton
(74) *Attorney, Agent, or Firm*—Thomas, Kayden, Horstemeyer & Risley

(57) ABSTRACT

A tie-down strap frame connector (10) for use in a stabilizing foundation system for a manufactured home which comprises a frame including at least one flanged support beam. The tie-down strap frame connector comprises a clamp assembly (26) that includes a base plate (30) and at least one wedge plate (45), and a swivel plate (28) that includes a tie-down strap slot (54). The wedge plate, base plate, and swivel plate each can be pivotally connected to each other with a coupling member (52) such that the swivel plate can pivot about the base plate to avoid the creation of undue torsional stress concentrations within the tie-down strap.

19 Claims, 4 Drawing Sheets

TIE-DOWN STRAP FRAME CONNECTOR

CROSS REFERENCE TO RELATED APPLICATION

This is a continuation-in-part of U.S. patent application Ser. No. 09/195,468, filed Nov. 18, 1998, now U.S. Pat. No. 5,983,573.

FIELD OF THE INVENTION

The invention relates generally to a frame connector for use in a manufactured home stabilizing foundation system using tie-down straps. More particularly, the invention relates to a frame connector which does not create harmful stress concentrations within the tie-down straps when the straps are arranged in non-perpendicular orientations with respect to the manufactured home.

BACKGROUND OF THE INVENTION

Manufactured homes, such as mobile homes, trailers, prefabricated homes, and the like are manufactured at a central manufacturing site and, upon completion, are moved to a location where they are to be occupied. Because these homes are designed to be easily moved from one site to another, they are not built on permanent foundations but, rather, typically are placed on piers such as concrete blocks, pilings, or stabilizing jacks. Normally, the piers directly support the frame of the manufactured home which typically comprises two or more support beams, such as steel I-beams, to which the home is fixedly secured.

If the manufactured home is not anchored securely in position on its piers, the home can be shifted by strong winds or earth tremors which can cause the home to be forced from its foundation. Due to this risk, various types of stabilizing systems have been used to stabilize the manufactured homes on their piers to keep the homes from shifting in response to wind and/or seismic forces. In one particularly effective system, a plurality of tie-down straps are used to tether the manufactured home to the ground. In these systems, the tie-down straps typically extend perpendicularly outwardly from incremental positions along the length of the manufactured home. Usually, the tie-down straps extend downwardly from the support beams of the manufactured home frame to ground anchors that are deeply embedded into the soil. Often, the tie-down straps are securely connected to the beams with frame connectors that latch onto the support beams. Normally, these frame connectors comprise a metal clamp assembly that includes a hook which securely grips an upper flange of the support beam. The tie-down straps usually are threaded through a strap slot formed in the clamp assembly. These strap slots normally are configured so as to be parallel to the hook and the longitudinal direction of the manufactured home, such that the tie-down straps can be positioned substantially perpendicularly to the longitudinal axis of the manufactured home.

Although functioning adequately under most circumstances, conventional frame connectors present several drawbacks. Most importantly, these frame connectors do not account for longitudinal shifting of the manufactured home due to wind or seismic forces. When a manufactured home shifts under the influence of such forces, the longitudinal position of the frame connectors, and their strap slots, likewise shift in the longitudinal direction. Because the ground attachment points of the tie-down straps are fixed by the anchors, the tie-down straps cannot similarly shift longitudinally, causing the tie-down straps to become arranged in diagonal orientations with respect to the manufactured home. In that the strap slots of the frame connector cannot reorient themselves to accommodate for the diagonal orientations of the straps, torsional stresses are concentrated on the straps at the point where the straps connect to the frame connectors.

Such stress concentrations can similarly occur in situations in which the tie-down straps are improperly installed in a non-perpendicular orientation relative to the manufactured home. Also, there are instances when obstructions prevent the tie down strap from being oriented at a right angle with respect to the length of the support beam. If large enough, these stresses can cause failure of one or more of the tie-down straps, placing the home in jeopardy of being forced from its foundation. Even if not causing strap failure, these torsional stresses can remove the stabilizing foundation system from compliance with the standards stipulated by the United States Department of Housing and Urban Development (HUD).

From the above, it can be appreciated that it would be desirable to have a frame connector which does not create harmful stress concentrations on the tie-down strap when the strap is orientated in a non-perpendicular orientation with respect to the home.

SUMMARY OF THE INVENTION

Briefly described, the present invention relates to a tie-down strap frame connector in combination with a stabilizing foundation system for a manufactured home. The manufactured home is supported on a frame including at least one I-shaped beam that supports the home. The tie-down strap frame connector comprises a clamp assembly that includes a base plate which rests on a pier and receives the lower flange of the I-shaped support beam of the manufactured home. At least one wedge plate is connected at one of its edges to the edge of the base plate and slopes over the lower flange of the I-shaped support beam and its other edge wedges against the central web of the I-shaped support beam. A swivel plate is pivotally connected to the base plate. The pivotal connection is formed by a connector bolt that extends through aligned openings of all of the base plate, swivel plate and wedge plate.

The swivel plate also includes a strap slot that is formed adjacent its distal end which is adapted to receive one end of a tie-down strap of the stabilizing foundation system. The swivel plate is angled intermediate its end so that its end which defines the connector opening can be placed in flat abutment with the base plate, and its distal end which includes the strap slot is oriented so as to be sloped downwardly toward a ground anchor that is to connect to the other end of the strap. When connected in this manner, the swivel plate can pivot about the base plate so that the strap slot can be arranged in non-perpendicular orientations with respect to the length of the I-shaped support beam that supports the home. With this arrangement, less torsional stress forces will be experienced by the tie-down strap.

The objects, features, and advantages of this invention will become apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
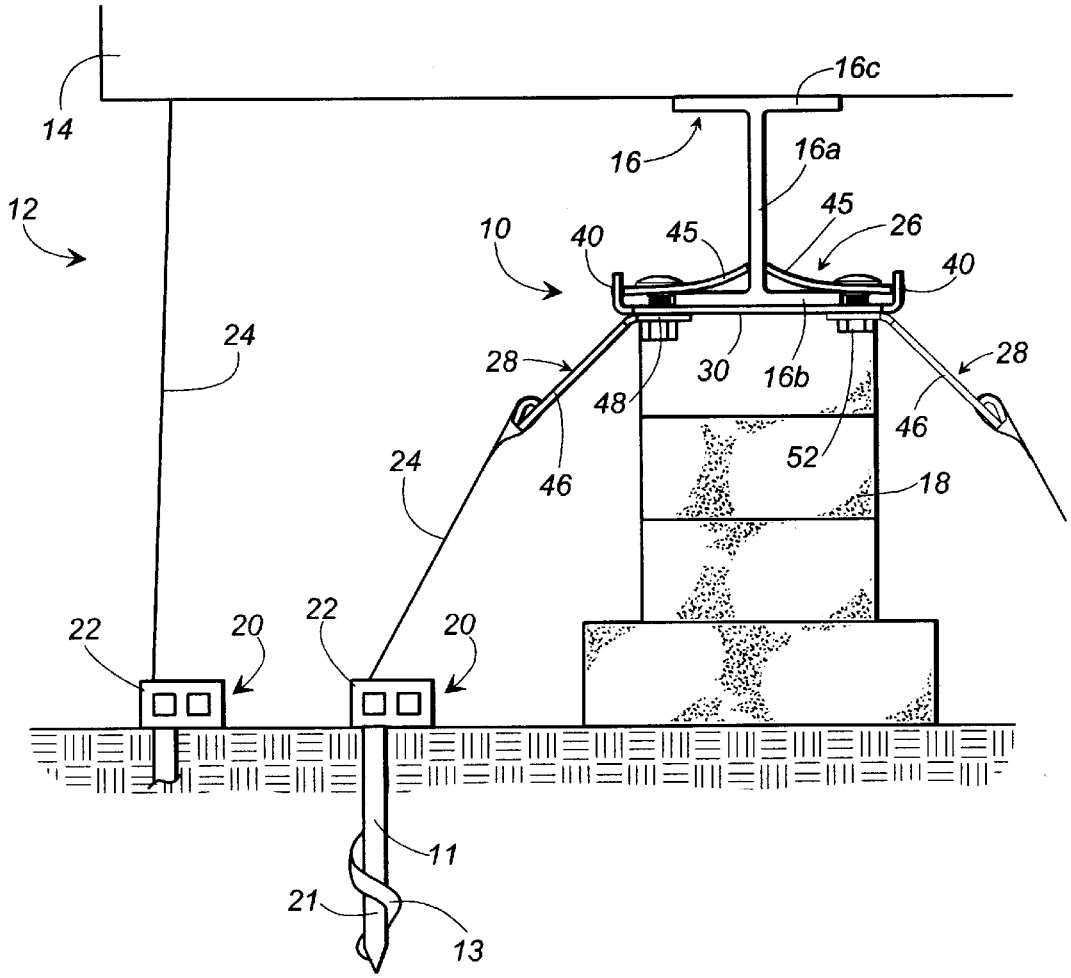
FIG. 1 is a partial end view a manufactured home and manufactured home stabilizing foundation system which includes a frame connector constructed in accordance with the present invention.

Referring now in more detail to the drawings, in which like reference numerals indicate corresponding parts throughout the several views, FIG. 1 illustrates a tie-down strap frame connector 10 as used in a stabilizing foundation system 12 for a manufactured home 14.

As shown in FIG. 1, the manufactured home 14 is supported by a frame comprising at least one I-shaped support beam 16 and a plurality of support piers 18. Normally, the support beams 16 are formed as steel I-beams having a vertically oriented central web 16*a* and lower and upper horizontal flanges 16*b* and 16*c*. The support piers 18 typically would be concrete blocks that support the lower horizontal flange of the I-shaped support beam. The stabilizing foundation system 12 typically includes a plurality of ground anchors 20, each including an anchor shaft 11 with a helical blade 13 and a tension head 22 at the upper end of the anchor shaft which facilitates attachment of tie-down straps 24 to the anchor. The tie-down straps 24 normally extend upwardly from their respective ground anchors 20 to connect to the manufactured home 14. As indicated in FIG. 1, the tie-down straps 24 can extend about the outer periphery of the manufactured home 14 or, alternatively, connect to the support beams 16 of the manufactured home frame. In the latter case, connection is facilitated by the tie-down strap frame connector 10.

Figure 2:
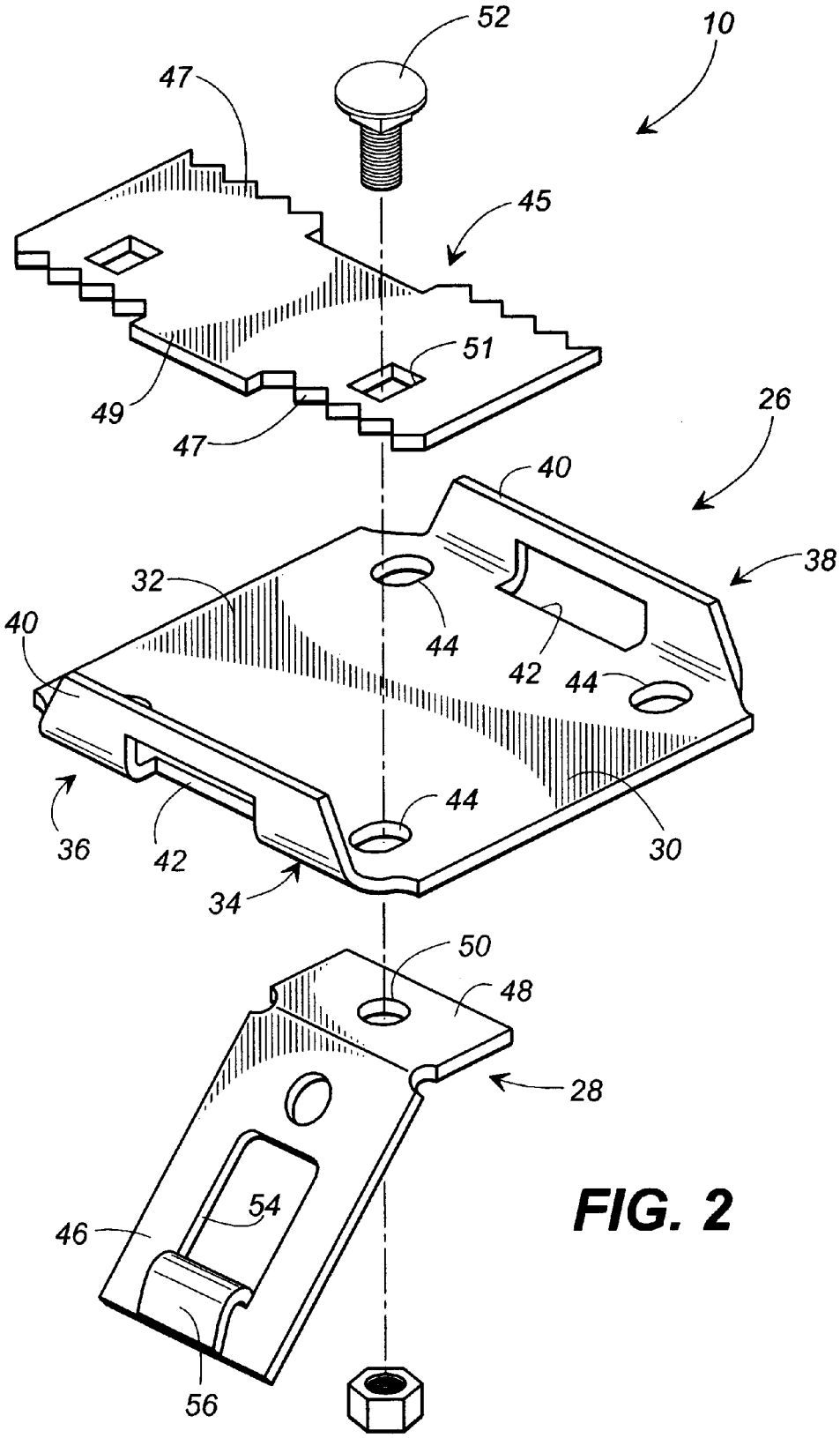
FIG. 2 is a perspective expanded view of a disassembled frame connector.

FIG. 2 illustrates the tie-down strap frame connector 10 in detail. As shown in this figure, the frame connector 10 generally comprises a clamp assembly 26 and a swivel plate 28. The clamp assembly 26 includes a substantially planar base plate 30 having top and bottom sides 32 and 34 and opposed lateral sides 36, 38. Extending upwardly from the lateral sides 36, 38 of the base plate 30 are opposed side flanges 40. The side flanges 40 typically are substantially planar in shape and are formed integrally with the base plate 30. Normally, the side flanges 40 are oriented in a plane that forms an approximately 90° angle with the plane that contains the base plate 30. The side flanges 40 typically further include tab slots 42 that are formed therein, the purpose for which is described below. In addition, the base plate 30 normally includes a plurality of coupling openings 44.

In addition to the base plate 30, the clamp assembly 26 includes at least one wedge plate 45, usually one on each side of the central web 16*a* of the support beam 16. Although typically two such wedge plates 45 are used, only one wedge plate 45 is shown in FIG. 2 for clarity. Each wedge plate 45 typically is substantially planar in shape and normally is provided with a plurality of locking teeth 47 which are formed on opposite edges of the wedge plate. In addition to these teeth 47, the outer periphery of the wedge plate includes a retaining tab 49. For purposes that will be discussed later in this disclosure, the retaining tab 49 is sized and configured to protrude from the wedge plate and be received within one of the slots 42 provided in each of the base plates 30. The wedge plate 45 further includes at least one coupling opening 51. Preferably, each of the coupling openings 51 is substantially square in shape so that it can receive the head of a conventional fastener such as a carriage bolt.

The swivel plate 28 comprises a strap connection portion 46 and a clamp assembly connection portion 48. Typically, both the strap connection portion 46 and the clamp assembly connection portion 48 are substantially planar in shape and oriented in separate planes so as to be arranged at an obtuse angle with respect to each other. The swivel plate 28 further includes at least one coupling opening 50 that is positioned so as to align with one of the coupling openings 44 of the clamp assembly base plate 30 and one of the coupling openings 51 of the wedge plate 45. As is explained below, these coupling openings 44, 50, and 51 are adapted to receive a coupling member 52 such as a bolt or pin about which the swivel plate 28 can pivot relative to the clamp assembly 26 (see FIGS. 4–5). The strap connection portion 46 further includes a strap slot 54 that is adapted to receive a tie-down strap 24. As indicated most clearly in FIG. 2, the strap slot 52 is provided with a substantially rounded lip 56 which directly receives the tie-down strap 24 to reduce stress imposed on the tie-down strap.

Figure 3:
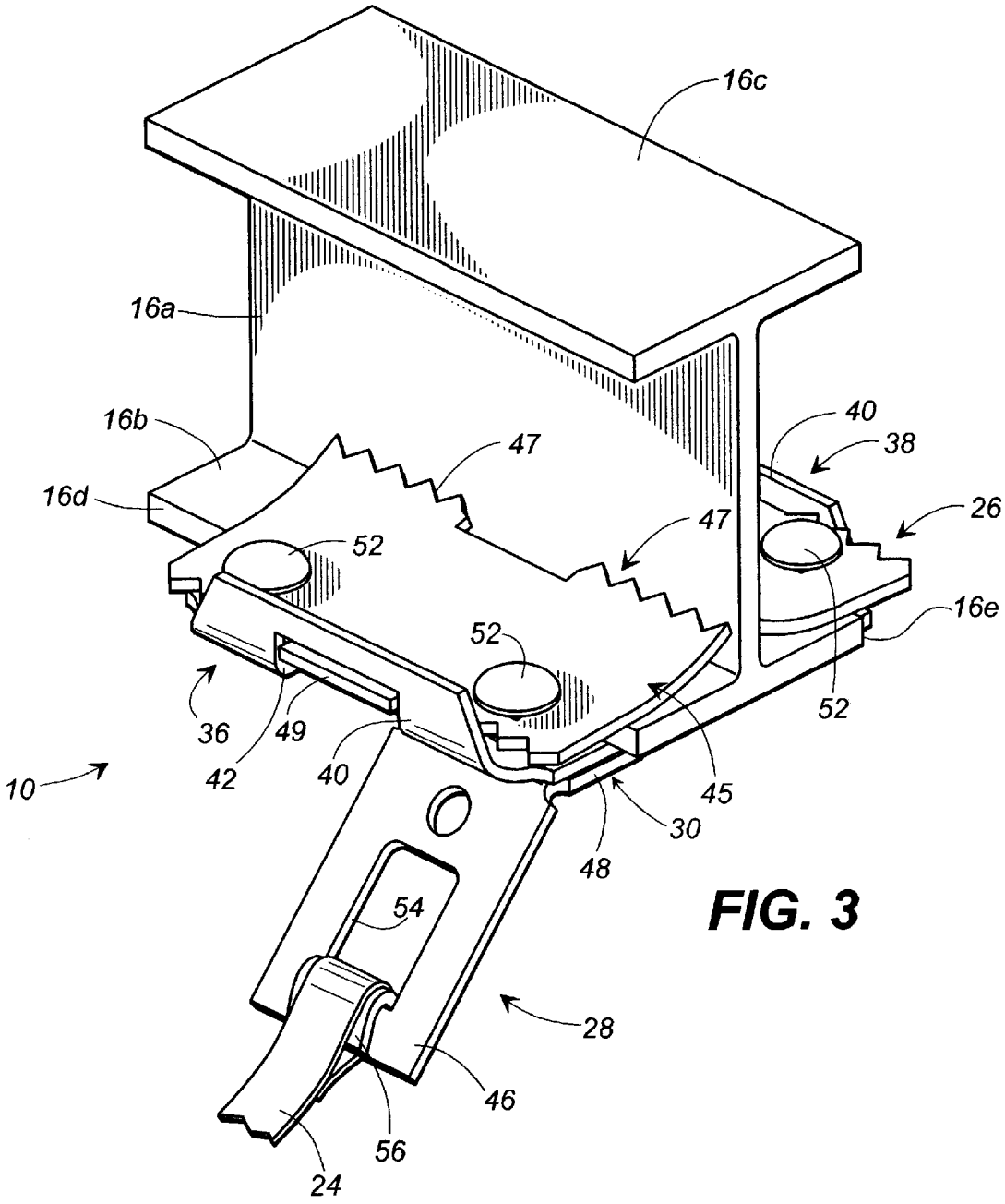
FIG. 3 is a perspective view of the frame connector of FIG. 2, shown connected to a support beam.

FIG. 3 depicts the tie-down strap frame connector 10 connected to a manufactured home support beam 16. As illustrated in FIG. 3, the body portion 30 of the clamp assembly 26 rests underneath the lower flange 16*b* of the support beam 16 with the opposed side flanges 40 of the base plate 30 positioned adjacent each opposed side edge 16*d* and 16*e* of a lower flange 16*b* of the support beam. When the clamp assembly 26 is placed in this position, the swivel plate 28 and the wedge plate 45 are coupled thereto with the coupling member 52. In particular, the coupling member 52 extends through aligned coupling openings 51, 44 and 50 provided in each of the wedge plate 45, base member 30, and swivel plate 28, respectively. When the frame connector 10 is assembled in this manner, the swivel plate 28 can pivot relative to the clamp assembly 28 about the coupling member 52.

When the coupling member 52 is firmly tightened, the wedge plate 45 is drawn downwardly and its teeth 47 on its opposed edges are placed in firm frictional contact between a side flange 40 of the base plate 30 and the central web 16*a* of the I-beam to securely hold the clamp assembly 26 in place. Longitudinal shifting of the wedge plate 45 relative to the base plate 30 is prevented through the coupling of the retaining tab 49 through the slot 42 of the base plate. As is further indicated in FIG. 3, the clamp assembly connection portion 48 of the swivel plate 28 is positioned in contact with the bottom side 34 of the base plate 30 underneath the support beam 16. When secured in this fashion, the frame connector 10 is locked in place on the support beam 16 such that the frame connector will not easily become dislodged from the beam if and when the manufactured home 14 is shifted in either the longitudinal or lateral direction.

Figure 4:
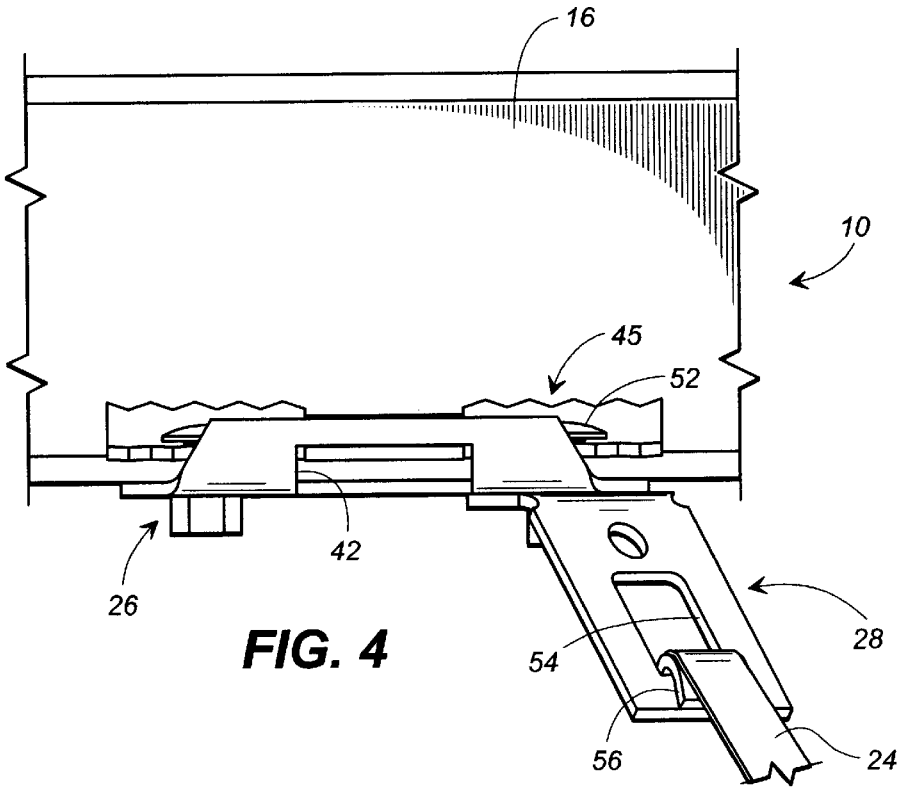
FIG. 4 is a side view of the frame connector of FIGS. 2–3 shown connected to a support beam in a first non-perpendicular orientation.
Figure 5:
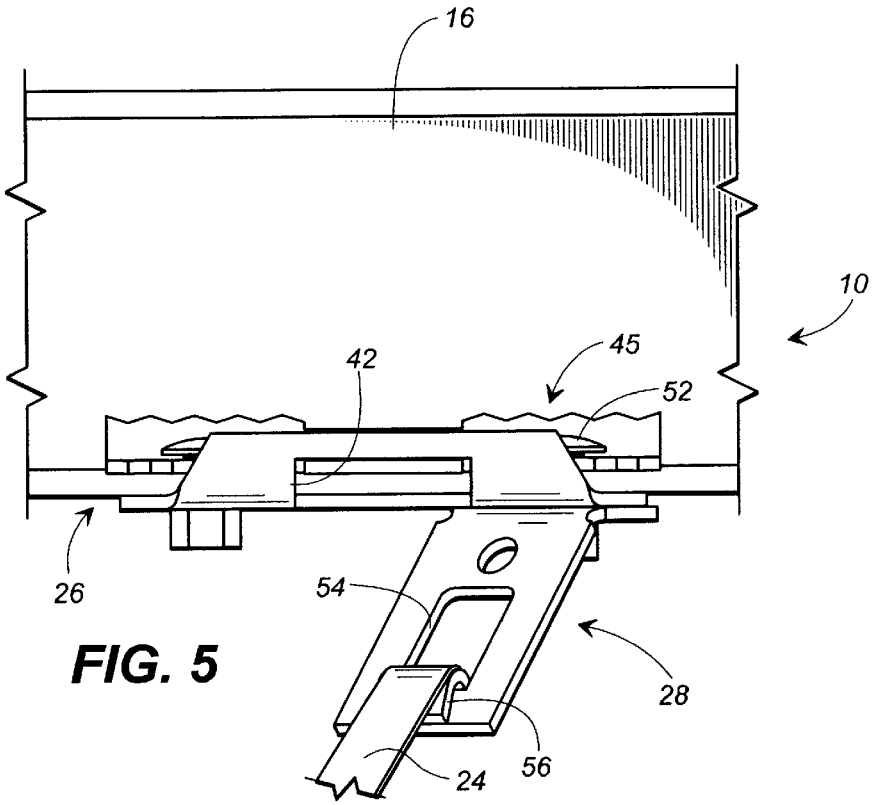
FIG. 5 is a side view of the frame connector of FIGS. 2–4 shown connected to a support beam in a second non-perpendicular orientation.

FIGS. 4 and 5 depict the frame connector 10 and support beam 16 shown in FIG. 3 with the frame connector 10 and its associated tie-down strap 24 oriented in two distinct nonperpendicular orientations. These non-perpendicular orientations of the connector 10 and strap 24 either can be the result of longitudinal shifting of the manufactured home or the result of non-perpendicular positioning of the tie-down straps during installation. In either case, the swivel plate 28 is pivoted about the coupling member 52 to accommodate the nonperpendicular orientation of the tie-down strap 24. This pivoting permits the strap slot 54 of the swivel plate 28 to be arranged in non-parallel orientations relative to the support beam 16 and the base plate 30 of the clamp assembly 26 connected thereto so that the tie-down strap 24 can be arranged in non-perpendicular orientations relative to the manufactured home. As can be appreciated from these figures, undue torsional stress concentrations that might be created within the strap by conventional frame connectors are reduced or avoided by the present frame connector 10 in that the rounded lip 56 of the strap slot 54 is maintained in a perpendicular orientation relative to the longitudinal axis of the tie-down strap 24, regardless of the strap's orientation relative to the manufactured home.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A tie-down assembly for a manufactured home of the type including at least one I-shaped support beam with a vertically oriented central web and upper and lower parallel flanges straddling the web, said tie-down assembly including:

a pier for resting on a ground surface beneath a manufactured home in supporting relationship with respect to the I-shaped support beam, a clamp assembly connected to the I-shaped support beam, an anchor extending into the ground surface, a strap extending between said clamp assembly and said anchor, said clamp assembly including:

a base plate having a lower surface and an upper surface, said upper surface receiving the lower flange of the I-shaped support beam, a wedge plate pivotally connected to the upper surface of said base plate and extending over a portion of the lower flange of the I-shaped support beam and including a friction edge in wedged engagement with the central web of the I-shaped support beam, a swivel plate including a mounting end and a connector end angled with respect to each other, said mounting end pivotally connected in parallel relationship with respect to the lower surface of said support plate and arranged to swivel parallel to said support plate, and said connector end sloped downwardly from said support plate toward said anchor, a connector arranged to draw said wedge plate and said swivel plate together on said base plate to urge the friction edge of said wedge plate into engagement with the central web of the I-shaped support beam, and said strap having a first end connected to said swivel plate and a second end connected to said anchor.

2. The tie-down assembly of claim 1, wherein:

said swivel plate includes a slot formed in said connector end, and said first end of said strap extending through said slot.

3. The tie-down of claim 1, wherein:

said friction edge of said wedge plate is of a saw tooth configuration.

4. The tie-down of claim 2, wherein:

said connector comprises a bolt.

5. The tie-down of claim 1, wherein:

said wedge plate comprises a pair of wedge plates in straddling relationship with the central web of the I-shaped support beam.

6. The tie-down of claim 5, wherein:

said base plate includes opposed side flanges, and said wedge plates extend in wedged relationship between said side flanges and said central web of the I-shaped support beam.

7. A tie-down assembly for a manufactured home of the type having at least one I-shaped support beam with a vertically oriented central web and horizontally extending flanges straddling the support web, comprising:

a pier supported on the ground surface beneath the manufactured home and supporting the I-shaped support beam, an anchor displaced laterally from and below the I-shaped support beam and extending into the ground surface, a non-penetrating clamp assembly frictionally mounted to the lower flange and to the central web of the I-shaped support beam on opposite sides of the central web of the I-shaped support beam, a strap having first and second ends, said first end connected to said anchor and said second end connected to said clamp assembly.

8. A tie-down strap frame connector for use in a stabilizing foundation system for a manufactured home which comprises a frame including at least one flanged support beam, said tie-down strap frame connector comprising:

a clamp member adapted to securely attach to a flange of the manufactured home support beam, said clamp member including a base portion and a trap member, said base portion and said trap member each including at least one coupling opening formed therein;

a swivel member including a coupling opening and a strap slot adapted to receive a tie-down strap of the stabilizing foundation system; and a coupling member sized and configured to extend through each of said coupling openings to pivotally connect said trap member, said base portion, and said swivel member such that said swivel member can pivot about said base portion such that said strap slot can be arranged in non-parallel orientations with respect to said base portion so that the tie-down strap can be arranged in non-perpendicular orientations with respect to the manufactured home without creating a torsional stress concentration within the tie-down strap.

9. The frame connector of claim 8, wherein said swivel member comprises a strap connection portion and a clamp member connection portion, said coupling opening of said swivel member being formed in said clamp member connection portion and said strap slot being formed in said strap connection portion.

10. The frame connector of claim 9, wherein said strap connection portion and said lock portion of said swivel member each are substantially planar in shape.

11. The frame connector of claim 10, wherein said strap connection portion and said lock portion of said swivel member are oriented in separate planes so as to form an obtuse angle with respect to each other.

12. The frame connector of claim 8, wherein said base plate of said clamp member is substantially planar in shape and includes at least one side flange that is adapted to abut a flange formed on the support beam.

13. The frame connector of claim 12, wherein said at least one side flange includes a tab slot and wherein said trap member includes a tab sized and configured to be received by said tab slot.

14. The frame connector of claim 12, wherein said wedge plate includes a plurality of teeth formed around the periphery of said trap member that are adapted to firmly engage the flanged support beam.

15. A tie-down strap frame connector for use in a stabilizing foundation system for a manufactured home which comprises a frame including at least one flanged support beam, said tie-down strap frame connector comprising:

a side flange adapted to abut a flange of the manufactured home support beam;

a strap slot adapted to receive a tie-down strap of the stabilizing foundation system; and means for altering the orientation of said strap slot so that said strap slot can be arranged in non-parallel orientations with respect to said side flange so that the tie-down strap can be arranged in non-perpendicular orientations with respect to the manufactured home without creating a torsional stress concentration within the tie-down strap.

16. The frame connector of claim 15, wherein said side flange is formed on a clamp member of said frame connector.

17. The frame connector of claim 16, wherein said clamp member includes a base plate and a trap member that cooperates therewith.

18. The frame connector of claim 17, wherein said trap member includes a tab and said base plate includes a tab slot that is sized and configured to receive said tab.

19. The frame connector of claim 15, wherein said means for altering the orientation of said strap slot comprises a swivel member in which said strap slot is formed, said swivel member being pivotably coupled to said clamp member such that said swivel member is pivotable relative to said clamp member.

* * * * *